US009377185B2

(12) United States Patent
Preuschl

(10) Patent No.: US 9,377,185 B2
(45) Date of Patent: Jun. 28, 2016

(54) LED LAMP

(75) Inventor: Thomas Preuschl, Sinzing (DE)

(73) Assignee: OSRAM GmbH, Munich (DE)

( * ) Notice: Subject to any disclaimer, the term of this patent is extended or adjusted under 35 U.S.C. 154(b) by 952 days.

(21) Appl. No.: 13/513,601

(22) PCT Filed: Nov. 29, 2010

(86) PCT No.: PCT/EP2010/068356

§ 371 (c)(1),
(2), (4) Date: Jun. 4, 2012

(87) PCT Pub. No.: WO2011/069848

PCT Pub. Date: Jun. 16, 2011

(65) Prior Publication Data

US 2012/0242226 A1 Sep. 27, 2012

(30) Foreign Application Priority Data

Dec. 10, 2009 (DE) ..... 10 2009 054 519

(51) Int. Cl.

| | |
|---|---|
| ***F21V 23/06*** | (2006.01) |
| ***F21K 99/00*** | (2016.01) |
| *F21Y 101/02* | (2006.01) |
| *F21V 3/00* | (2015.01) |

(52) U.S. Cl.

CPC ..... *F21V 23/06* (2013.01); *F21K 9/135* (2013.01); *F21V 3/00* (2013.01); *F21Y 2101/02* (2013.01)

(58) Field of Classification Search

CPC ..... F21V 23/06; F21K 9/135; F21K 9/1355; F21K 9/30

See application file for complete search history.

(56) References Cited

U.S. PATENT DOCUMENTS

| | | | | |
|---|---|---|---|---|
| 3,400,358 | A * | 9/1968 | Byrnes et al. | 439/75 |
| 3,634,819 | A * | 1/1972 | Evans | 439/825 |
| 4,230,384 | A * | 10/1980 | Anhalt | 439/81 |
| 5,189,339 | A | 2/1993 | Peshak | |
| 6,462,475 | B1 | 10/2002 | Lee | |
| 6,653,770 | B1 * | 11/2003 | Matsuba et al. | 313/318.04 |
| 6,734,633 | B2 * | 5/2004 | Matsuba et al. | 315/58 |
| 7,249,981 | B2 | 7/2007 | Chen | |
| 7,641,379 | B2 * | 1/2010 | Gisler | 362/652 |
| 7,871,184 | B2 | 1/2011 | Peng | |
| 8,342,711 | B2 * | 1/2013 | Lin et al. | 362/249.02 |
| 8,398,266 | B2 * | 3/2013 | Wang | 362/249.02 |
| 8,434,883 | B2 * | 5/2013 | Doan et al. | 362/84 |
| 8,441,214 | B2 * | 5/2013 | Anderson | 315/318 |

(Continued)

FOREIGN PATENT DOCUMENTS

| | | |
|---|---|---|
| CN | 2217722 Y | 1/1996 |
| CN | 1120797 A | 4/1996 |

(Continued)

OTHER PUBLICATIONS

Chinese office action issued Mar. 5, 2014 and English translation thereof.

Office Action issued in the corresponding German application No. 102009054519.0, dated Jun. 4, 2014.

English abstract of CN1120797A, dated Apr. 17, 1996.

European Search Report based on Application No. 10 785 404.4 (6 pages) dated Nov. 25, 2015 (Reference Purpose Only).

*Primary Examiner* — Thomas J Hiltunen

(74) *Attorney, Agent, or Firm* — Viering, Jentschura & Partner mbB

(57) ABSTRACT

A light emitting diode lamp may include a socket; a first circuit board; and at least one plug connector electrically connected to the socket; wherein the connector is connected to the circuit board by means of a plug section.

11 Claims, 4 Drawing Sheets

(56) References Cited

U.S. PATENT DOCUMENTS

| | | | | |
|---|---|---|---|---|
| 8,449,169 | B2 * | 5/2013 | Maslowski et al. | 362/646 |
| 8,585,251 | B2 * | 11/2013 | Scott | 362/311.02 |
| 8,622,587 | B2 * | 1/2014 | Preuschl et al. | 362/364 |
| 8,664,840 | B2 * | 3/2014 | Lin et al. | 313/49 |
| 8,890,306 | B2 * | 11/2014 | Reill et al. | 257/699 |
| 8,896,005 | B2 * | 11/2014 | Van De Ven et al. | 257/98 |
| 9,030,120 | B2 * | 5/2015 | Pickard et al. | 315/291 |
| 2003/0151917 | A1 * | 8/2003 | Daughtry et al. | 362/231 |
| 2005/0057187 | A1 | 3/2005 | Catalano | |
| 2009/0040758 | A1 | 2/2009 | Tu et al. | |
| 2009/0079321 | A1 | 3/2009 | Liang | |
| 2009/0146561 | A1 * | 6/2009 | Jiang | 313/512 |
| 2009/0218923 | A1 * | 9/2009 | Gingrich et al. | 313/1 |
| 2011/0130053 | A1 | 6/2011 | Emde et al. | |
| 2011/0222282 | A1 * | 9/2011 | Preuschl | 362/249.01 |
| 2014/0035118 | A1 * | 2/2014 | Bayerer, Reinhold | 257/690 |

FOREIGN PATENT DOCUMENTS

| | | | |
|---|---|---|---|
| CN | 2378628 | Y | 5/2000 |
| CN | 101218713 | A | 7/2008 |
| CN | 201293233 | Y | 8/2009 |
| DE | 20115131 | U1 | 1/2002 |
| DE | 202007009655 | U1 | 10/2007 |
| DE | 202008006325 | U1 | 8/2008 |
| DE | 102008001787 | A1 | 11/2009 |
| DE | 102008056923 | A1 | 5/2010 |
| EP | 2149742 | A2 | 2/2010 |
| JP | 2002304902 | A | 10/2002 |
| WO | 2007028671 | A1 | 3/2007 |

* cited by examiner

LED LAMP

RELATED APPLICATIONS

The present application is a national stage entry according to 35 U.S.C. §371 of PCT application No.: PCT/EP2010/068356 filed on Nov. 29, 2010, which claims priority from German application No.: 10 2009 054 519.0 filed on Dec. 10, 2009.

TECHNICAL FIELD

The invention relates to LED lamps according to the preamble of claim 1.

BACKGROUND

LED lamps are known which have a circuit board and a socket which are electrically connected to each other by means of cables. In this case, the cables have to be secured and contacted on the circuit board in a very complex way (e.g. by soldering).

SUMMARY

Various embodiments provide an LED lamp with which the establishment of an electrical connection of a circuit board is simplified by means of a socket.

Various embodiments provide an LED lamp having a socket and having a first circuit board wherein at least one plug connector that is electrically connected to the socket is provided and said connector is connected to the circuit board by means of a plug section. This may establish an electrical connection between the socket and the circuit board in a simpler way than in the prior art.

The plug connector is advantageously a press-fit connector or an insulation displacement contact.

In a particularly preferred embodiment of the LED lamp according to the invention, the plug section is accommodated in a recess of the circuit board, wherein a through-recess is arranged in the plug section. The plug sections are characterized by ease of assembly.

In a particularly preferred further development of the LED lamp, a second end section of the at least one press-fit connector is welded or soldered or clamped to the socket. This provides an electrical and mechanical connection between the circuit board and the socket.

In a preferred embodiment of the LED lamp, its shape approximately corresponds to that of a conventional incandescent bulb. This provides a retrofit lamp that can be screwed into conventional holders, wherein its efficiency or luminous efficiency is improved.

In this case, it is preferable for the first circuit board to be approximately circular. This enables the circuit board to be fitted into the retrofit lamp with an optimal size.

A particularly preferred further development of the LED lamp has two press-fit connectors, wherein the second end section of the first press-fit connector is secured to a lower section of the socket and the second end section of the second press-fit connector is secured to a lateral peripheral section of the socket.

A preferred further development has a metal-core circuit board to which a plurality of LEDs is secured which is connected to the first circuit board by means of two further press-fit connectors.

In a preferred embodiment, an electrically insulating casting compound is accommodated in the socket. This enables the press-fit connectors extending in the interior of the socket to be electrically insulated from each other.

In this case, it is preferable for an electrical component to be accommodated in the casting compound. This enables the electrical component to be fixed and to be electrically insulated from the press-fit connectors and the socket.

In this case, it is preferable for the electrical component to be an electrolytic capacitor or a resistor connected to the two press-fit connectors.

In a preferred further development, the LED lamp has a guide bolt formed from the casting compound. Said guide bolt can be inserted in a cutout in the circuit board and serve as a locking element for the circuit board.

In a preferred embodiment, the LED lamp has a heat sink made of metal or heat-conducting plastic in which a driver board is accommodated. This enables heat to be removed from the LEDs and from the first circuit board and from the metal-core circuit board.

In this case, it is preferable for the heat sink to be approximately rotationally symmetrical, wherein a peripheral edge of a plastic bulb is secured to a first edge and wherein a peripheral edge of the socket is secured to a second edge. Hence, the heat sink serves as a connecting component between the lamp bulb and the socket.

BRIEF DESCRIPTION OF THE DRAWINGS

The following describes the invention in more detail with reference to exemplary embodiments. The figures show.

DETAILED DESCRIPTION

The following detailed description refers to the accompanying drawings that show, by way of illustration, specific details and embodiments in which the invention may be practiced.

Figure 1:
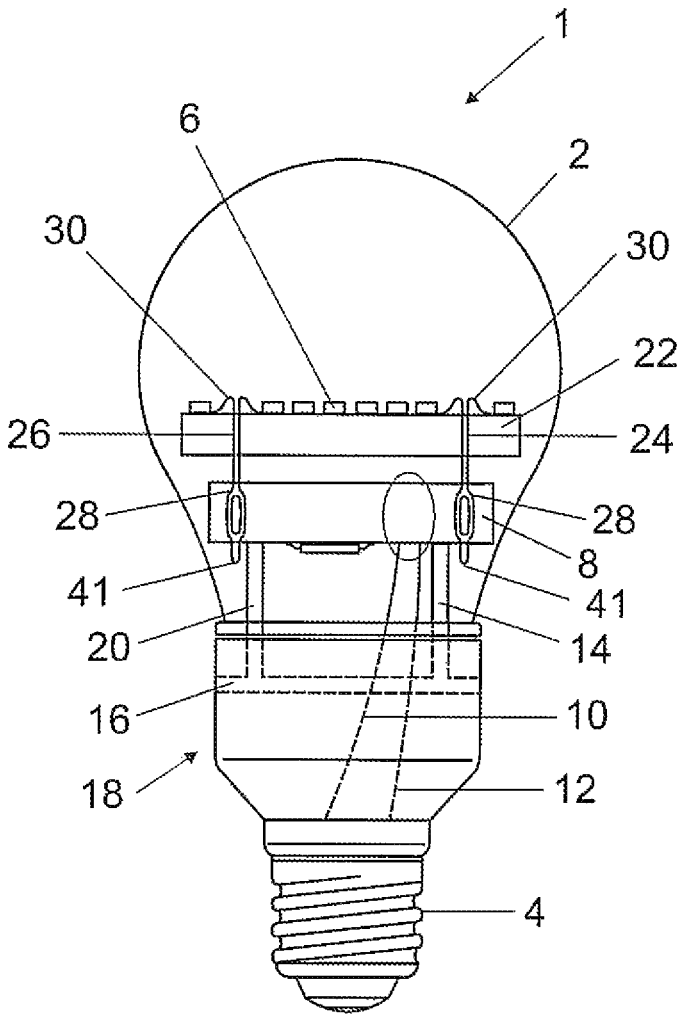
FIG. 1 a schematic representation of an LED lamp according to a first exemplary embodiment FIG. 2 a schematic representation of the socket of the LED lamp from FIG. 1

FIG. 1 is a schematic perspective side view of an LED lamp 1 according to a first exemplary embodiment. This lamp has a pear-shaped lamp bulb 2 with a socket 4. At least one LED 6 is arranged inside the lamp bulb 2, wherein a plurality of LEDs 6 is provided. The LED lamp 1 is preferably a so-called retrofit LED lamp. Its exterior should, for example, conform to that of a conventional incandescent lamp, but, in this case, it is not spiral wound filaments but energy-saving LEDs 6 that function as the light source. The socket 4 is designed to match conventional holders, such as, for example, E14, E27 or GU10.

According to the invention, electrical contacting between a circuit board 8 of the LED lamp 1 and the socket 4 is provided via plug connectors in the form of press-fit connectors 10, 12. These are only indicated schematically in FIG. 1 and are explained in more detail below with reference to FIG. 2.

The circuit board 8 is approximately plate-shaped and secured firmly on a support 14. Said support has a base section 16, supported on an inner wall of an approximately cylindrical bulb section 18 of the lamp bulb 2 facing toward the socket 4. Two longitudinal supports 20 extend from the transverse support 16 away from the socket 4, said longitudinal supports being firmly connected by mechanical means to the circuit board 8 in order to secure said circuit board.

The LEDs 6 are fixed on a side of a metal-core circuit board 22 pointing away from the socket 4, which is also connected mechanically and electrically to the circuit board 8 by means of two press-fit connectors 24, 26. The press-fit connectors 24, 26 are each pin-shaped and each have a press-fit contact or plug section 28 that is inserted in a through-hole (not shown) of the circuit board 8 and mechanically and electrically fixed thereto by means of a non-positive, cohesive and or positive connection.

A central section of the press-fit connectors 24, 26 is fed through through-holes of the metal-core circuit board 22, wherein an anchor element 30 is embodied on each of the end sections of the press-fit connectors 24, 26 facing away from the plug sections 28. Said anchor element grips the metal-core circuit board 22 from behind and fixes it in the longitudinal direction of the LED lamp 1. Hence, the press-fit connectors 24, 26 provide a rigid mechanical connection between the metal-core circuit board 22 and the circuit board 8 and simultaneously an electrical connection.

The press-fit connectors 24, 26 are produced inexpensively as stamped parts. The plug sections 28 are here embodied in the shape of the eye of a needle thus creating an elastic press-fit zone. In addition, the plug sections 28 of the press-fit connectors 24, 26 are inserted in through-holes of the circuit board 8, which have a smaller diameter than that of the plug sections 28 causing these to be substantially elastically deformed and held with an elastic clamping force in the through hole.

Figure 2:
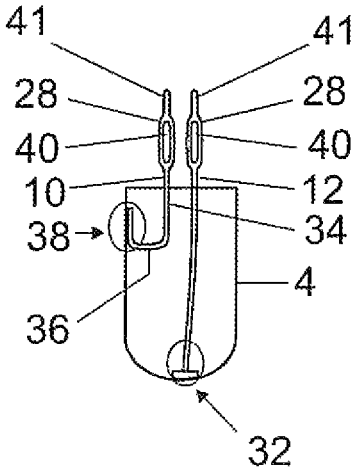

FIG. 2 is a schematic representation of the socket 4 with the press-fit connectors 10, 12 from FIG. 1.

To simplify matters, the axial extension of the press-fit connectors 10, 12 is shown in a slightly shortened form.

The press-fit connectors 10, 12 are embodied as mechanically rigid press-fit pins and each have a plug section 28 extending away from the socket 4. The plug sections 28 are embodied similarly to those of the press-fit connectors 24, 26 from FIG. 1.

The right-hand press-fit connector 12 in FIG. 2 extends approximately coaxially to a longitudinal axis of the socket 4 as far as a lower socket section 32 to which this is then welded, soldered or clamped for the electrical and mechanical connection. The left-hand press-fit connector 10 in FIG. 2 is bent approximately into an L shape, wherein a first limb 34 extends approximately parallel to the press-fit connector 12 and a second limb 36 extends radially to a lateral peripheral section 38 of the socket 4. The L-shaped press-fit connector 10 is then welded, soldered or clamped to an inner side of the peripheral section 38 for the electrical and mechanical connection to the socket 4.

In FIG. 1, the plug sections 28 of the press-fit connectors 10, 12 are each inserted in a recess of the circuit board 8 by means of by means of a non-positive, cohesive and or positive connection. The press-fit connectors 10, 12 from FIG. 2 have a longitudinal cutout in the form of a through-recess 40 on each of their plug sections 28. This makes the plug sections 28 elastically deformable thus enabling certain production tolerances of recesses of the circuit board 8 from FIG. 1 to be compensated.

The LED lamp according to the invention 1 from FIG. 1 enables extremely simple contacting between the circuit board 8 and the socket 4. There is no longer any need for soldering or welding of the circuit board 8 for example with current conducting cables for contact with the socket 4 as in the prior art. During assembly, the socket 4 with the press-fit connectors 24, 26 is simply plugged onto the circuit board 8 in that the plug sections 28 are inserted in the recesses of the circuit board 8.

Axial guide lugs 41 are embodied on the plug sections 28 of the press-fit connectors 10, 12, 24, 26 in FIGS. 1 and 2 said lugs being used for the simple introduction of plug sections 28 into the recesses of the circuit board 8 during assembly. These have a smaller diameter than the plug sections 28.

In assembled condition of the socket 4, the socket section 32 and the peripheral section 38 of the socket 4 ensure the press-fit connectors 12 or 10 are electrically contacted in a holder (not shown).

Alternatively to the press-fit connectors 10, 12, 24 or 26 described, it is also possible to use other plug connectors, such as, for example, insulation displacement contacts.

Figure 3:
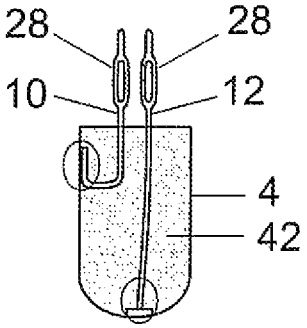
FIG. 3 a schematic representation of the socket of the LED lamp according to a second exemplary embodiment FIG. 4 a schematic representation of the socket of the LED lamp according to a third exemplary embodiment FIG. 5 a schematic representation of the LED lamp according to a fourth exemplary embodiment and FIG. 6 a schematic representation of the LED lamp according to a fifth exemplary embodiment.

FIG. 3 shows the socket 4 of an LED lamp 1 according to the invention from FIG. 1 according to a second exemplary embodiment.

Unlike the preceding exemplary embodiment from FIGS. 1 and 2, an electrically insulating casting compound 42 is introduced into the socket 4. This is used on the one hand for the electrical insulation of the press-fit connectors 10, 12 from each other and can, on the other hand, if it has a certain mechanical rigidity, is also able provide mechanical support for the press-fit connectors 10, 12. In this case, the press-fit connectors 10, 12 extend out of the casting compound 42 with the plug sections 28.

Figure 4:
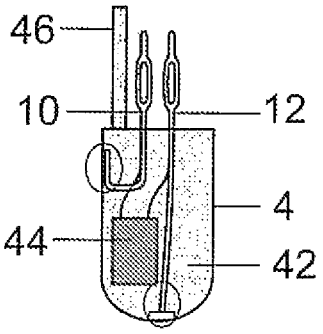

FIG. 4 shows a socket 4 of an LED lamp according to the invention in a third exemplary embodiment. In this case, the casting compound 42 accommodates an electrical component 44. This is an electrolytic capacitor or a resistor connected electrically and mechanically to the two press-fit connectors 10, 12. The casting compound 42 also forms a guide bolt 46, which extends out of the socket 4 approximately at a parallel distance to the press-fit connectors 10, 12. The guide bolt 46 has a larger axial length than the press-fit connectors 10, 12 and, during the assembly of the circuit board 8, can be inserted in a corresponding cutout of the circuit board 8, thus ensuring this is additionally supported and locked in position.

Figure 5:
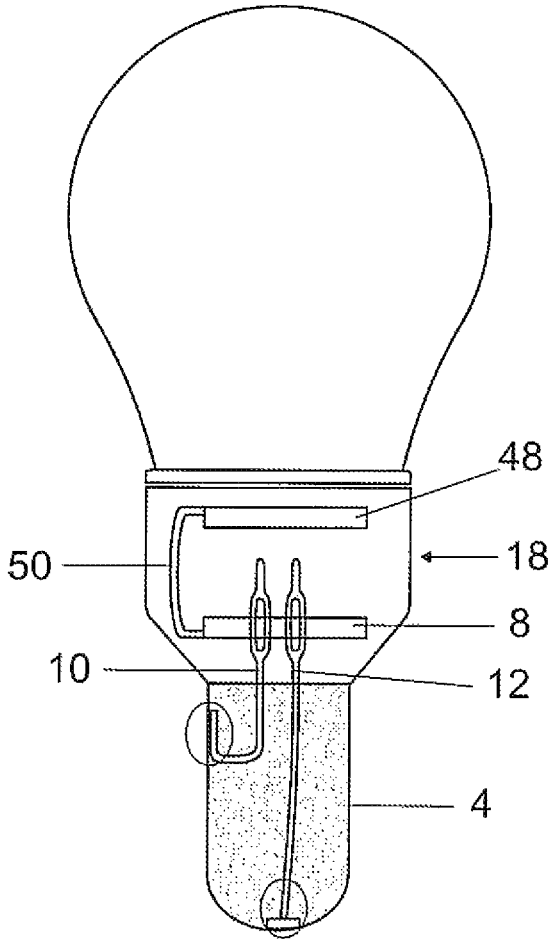

FIG. 5 is a schematic representation of the LED lamp 1 with the socket 4 from FIG. 3 according to a fourth exemplary embodiment. Unlike the LED lamp 1 from FIG. 1, there is no support 14. In this case, the circuit board 8 is held and electrically contacted by means of the press-fit connectors 10, 12. A further circuit board 48 comprising the LEDs is held at a parallel distance from and in electrical contact with the circuit board 8 by means of a clip 50. In this case, the circuit boards 8, 48 are arranged in the cylindrical bulb section 18 of the lamp bulb 2.

Figure 6:
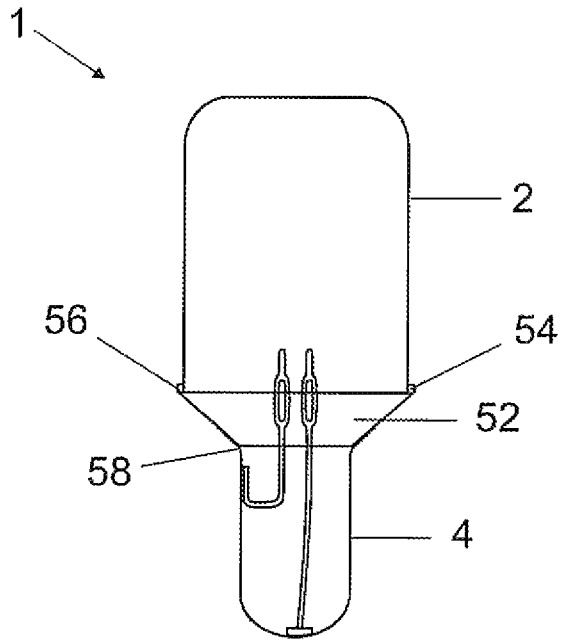

FIG. 6 is a schematic representation disclosing the LED lamp 1 according to a fifth exemplary embodiment. In this case, a heat sink is arranged as a ring-shaped sink element 52 between the lamp bulb 2 and the socket 4. Said element is made of metal or a heat-conducting plastic. The sink element 52 is used to cool the interior of the LED lamp 1 and is embodied as approximately rotationally symmetrical with respect to a truncated cone-shaped peripheral wall wherein a peripheral edge 56 of the cylindrical lamp bulb 2 in FIG. 6 is secured to a first edge 54 pointing away from the socket 4. The socket 4 is secured to a second edge 58 of the sink element 52 pointing toward the socket 4. The sink element 52 is secured to the socket 4 or the lamp bulb 2 by means of laser welding or bonding, for example. The connection can also be provided by means of latching, for example by means of a plurality of detent lugs or by the perforation or squashing of the socket 4, the sink element 52 and the lamp bulb 2.

The sink element 52 accommodates is a driver board (not shown) connected to the circuit board 8 from FIG. 1 or FIG. 5.

To secure a lamp bulb, two approximately diametrically arranged spring clips can protrude on the socket 4 approximately in the longitudinal direction and engage in corresponding recesses of the lamp bulb in order to hold the lamp bulb.

The invention relates to an LED lamp having a socket and having a first circuit board. At least one press-fit connector electrically connected to the socket is provided. Said connector is connected to the circuit board by means of a plug section.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A light emitting diode lamp, comprising:

a socket;

a first circuit board at least one plug connector electrically connected to the socket; and a metal-core circuit board on which a plurality of light emitting diodes are secured, wherein the metal-core circuit board is connected to the first circuit board by means of two further press-fit connectors, wherein the connector is connected to the circuit board by means of a plug section; and wherein the plug section is accommodated in a recess of the circuit board and wherein a through-recess is arranged in the plug section, wherein the plug connector is a press-fit connector or an insulation displacement contact.

2. The light emitting diode lamp as claimed in claim 1, wherein a second end section of the at least one press-fit connector is welded or soldered or clamped onto an inner side of the socket for the electrical and mechanical connection.

3. The light emitting diode lamp according to claim 1, wherein its shape approximately corresponds to that of a conventional incandescent bulb.

4. The light emitting diode lamp as claimed in claim 3, wherein the first circuit board is approximately circular.

5. The light emitting diode lamp as claimed in claim 3, further comprising:

two press-fit connectors, wherein the second end section of the first press-fit connector is secured to a lower section of the socket and the second end section of the second press-fit connector is secured to a lateral peripheral section of the socket.

6. The light emitting diode lamp as claimed in claim 2, wherein an electrically insulating casting compound is accommodated in the socket.

7. The light emitting diode lamp as claimed in claim 6, wherein an electrical component is accommodated in the casting compound.

8. The light emitting diode lamp as claimed in claim 4, wherein an electrical component is accommodated in the casting compound; wherein the electrical component is an electrolytic capacitor or a resistor that is connected electrically and mechanically to the two press-fit connectors.

9. The light emitting diode lamp as claimed in claim 6, further comprising:

a guide bolt formed from the casting compound.

10. The light emitting diode lamp according to claim 1, further comprising:

a heat sink made of metal or heat-conducting plastic, in which a driver board is accommodated.

11. The light emitting diode lamp as claimed in claim 3, further comprising:

a heat sink made of metal or heat-conducting plastic, in which a driver board is accommodated;

wherein the heat sink is approximately rotationally symmetrical and wherein a peripheral edge of a plastic bulb is secured, for example, to a first edge and wherein a peripheral edge of the socket is secured to a second edge.

* * * * *